US007021250B2

(12) United States Patent
Marinica et al.

(10) Patent No.: US 7,021,250 B2
(45) Date of Patent: Apr. 4, 2006

(54) PRECISION COOLING SYSTEM

(75) Inventors: Liviu Marinica, Canton, MI (US); Christopher Barron, St. Clair Shores, MI (US); Traian Bajeu, Sterling Heights, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 10/867,134

(22) Filed: Jun. 14, 2004

(65) Prior Publication Data

US 2005/0056238 A1 Mar. 17, 2005

Related U.S. Application Data

(60) Provisional application No. 60/477,568, filed on Jun. 11, 2003.

(51) Int. Cl.
*F01P 3/02* (2006.01)

(52) U.S. Cl. ..... 123/41.72

(58) Field of Classification Search ..... 123/41.72, 123/41.74, 41.28, 41.44
See application file for complete search history.

(56) References Cited

U.S. PATENT DOCUMENTS

| | | | | |
|---|---|---|---|---|
| 4,284,037 | A * | 8/1981 | Kasting et al. | 123/41.72 |
| 4,305,348 | A * | 12/1981 | Martin | 123/41.82 R |
| 4,665,867 | A | 5/1987 | Iwamoto et al. | |
| 4,825,816 | A * | 5/1989 | Yamada et al. | 123/41.57 |
| 5,058,535 | A | 10/1991 | Wilkinson | |
| 5,255,636 | A | 10/1993 | Evans | |
| 5,337,704 | A * | 8/1994 | Roth | 123/41.1 |
| 5,487,363 | A | 1/1996 | Batzill et al. | |
| 5,606,937 | A | 3/1997 | Calhoun | |
| 5,970,927 | A * | 10/1999 | Suzuki | 123/41.29 |
| 6,109,220 | A | 8/2000 | Nakamura | |
| 6,279,516 | B1 | 8/2001 | Haugen et al. | |
| 6,349,697 | B1 * | 2/2002 | Kanda et al. | 123/295 |
| 6,357,399 | B1 | 3/2002 | Nakamura | |
| 6,681,727 | B1 | 1/2004 | Krenn | |

* cited by examiner

*Primary Examiner*—Henry C. Yuen
*Assistant Examiner*—Jason Benton
(74) *Attorney, Agent, or Firm*—Ralph E. Smith

(57) ABSTRACT

A precision cooling system directs the flow of coolant to optimize coolant flow around the cylinders of an internal combustion engine. This results in lower temperatures in the upper portion of the cylinders, more uniform temperatures throughout the engine, and a lower average temperature. The precision cooling system is integrated into the construction of the water jacket distributing coolant throughout the engine and particularly around the combustion cylinders.

11 Claims, 5 Drawing Sheets

PRECISION COOLING SYSTEM

CROSS-REFERENCE TO RELATED APPLICATIONS

This application claims the benefit of U.S. Provisional Application Ser. No. 60/477,568, filed Jun. 11, 2003.

STATEMENT REGARDING FEDERALLY SPONSORED RESEARCH

Not applicable.

BACKGROUND OF THE INVENTION

1. Field of the Invention

The invention relates to internal combustion engine cooling systems, particularly cooling of the combustion chambers.

2. Description of Related Art

The cooling system for an internal combustion engine circulates a cooling fluid around the combustion cylinders to transfer some of the heat of combustion from the combustion cylinders to a heat exchanger. Uneven cooling between and around the cylinders, and between upper and lower portions of each cylinder due to proximity to the combustion chamber, can result in distortion of the cylinders. In order to maintain a sufficient seal of the combustion chamber with a varying cylinder bore, larger piston rings are generally required to compensate. This generally results in greater friction losses in the engine.

Generally, conventional cooling systems also provide for coolant flow along a bank of combustion cylinders, whereby downstream cylinders are cooled less effectively. Coolant that has already passed over upstream cylinders has been raised in temperature, resulting in less efficient heat transfer due to the smaller temperature differential between the cylinder and the coolant.

It would be advantageous to provide an engine cooling system that directs the cooling fluid in a manner to provide more effective cooling of each cylinder, and more uniform cooling among the plurality of cylinders.

BRIEF SUMMARY OF THE INVENTION

A precision cooling system for an internal combustion engine includes a plurality of coolant channels formed in the engine block and associated with a plurality of combustion chambers, the coolant channels fluidly connecting a coolant inlet and a coolant outlet. A dividing wall defines a lower coolant channel and an upper coolant channel and separates the lower coolant channel from the upper coolant channel, with a crossover channel fluidly connecting the lower coolant channel and the upper coolant channel. The coolant inlet is directly fluidly connected with the lower coolant channel or the upper coolant channel, and the coolant outlet is directly fluidly connected with the other of the lower coolant channel and the upper coolant channel.

BRIEF DESCRIPTION OF THE SEVERAL VIEWS OF THE DRAWINGS

The present invention will become more fully understood from the detailed description and the accompanying drawings, wherein.

DETAILED DESCRIPTION OF THE INVENTION

This application claims the benefit of U.S. Provisional Application Ser. No. 60/477,568, filed Jun. 11, 2003, which is incorporated herein in its entirety.

Figure 1:
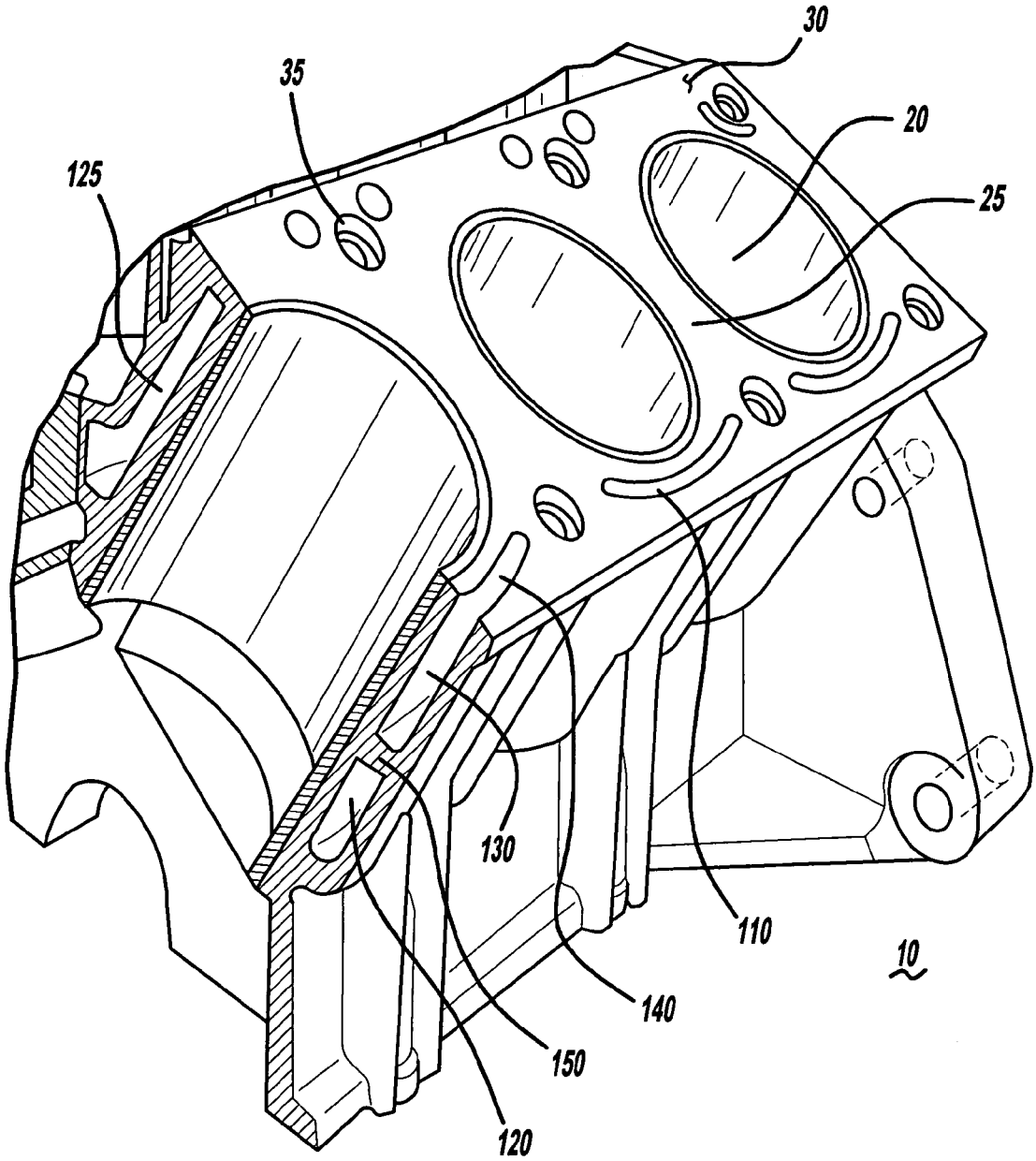
FIG. 1 is a perspective cutaway view of an engine block with a precision cooling system according to the invention.
Figure 2:
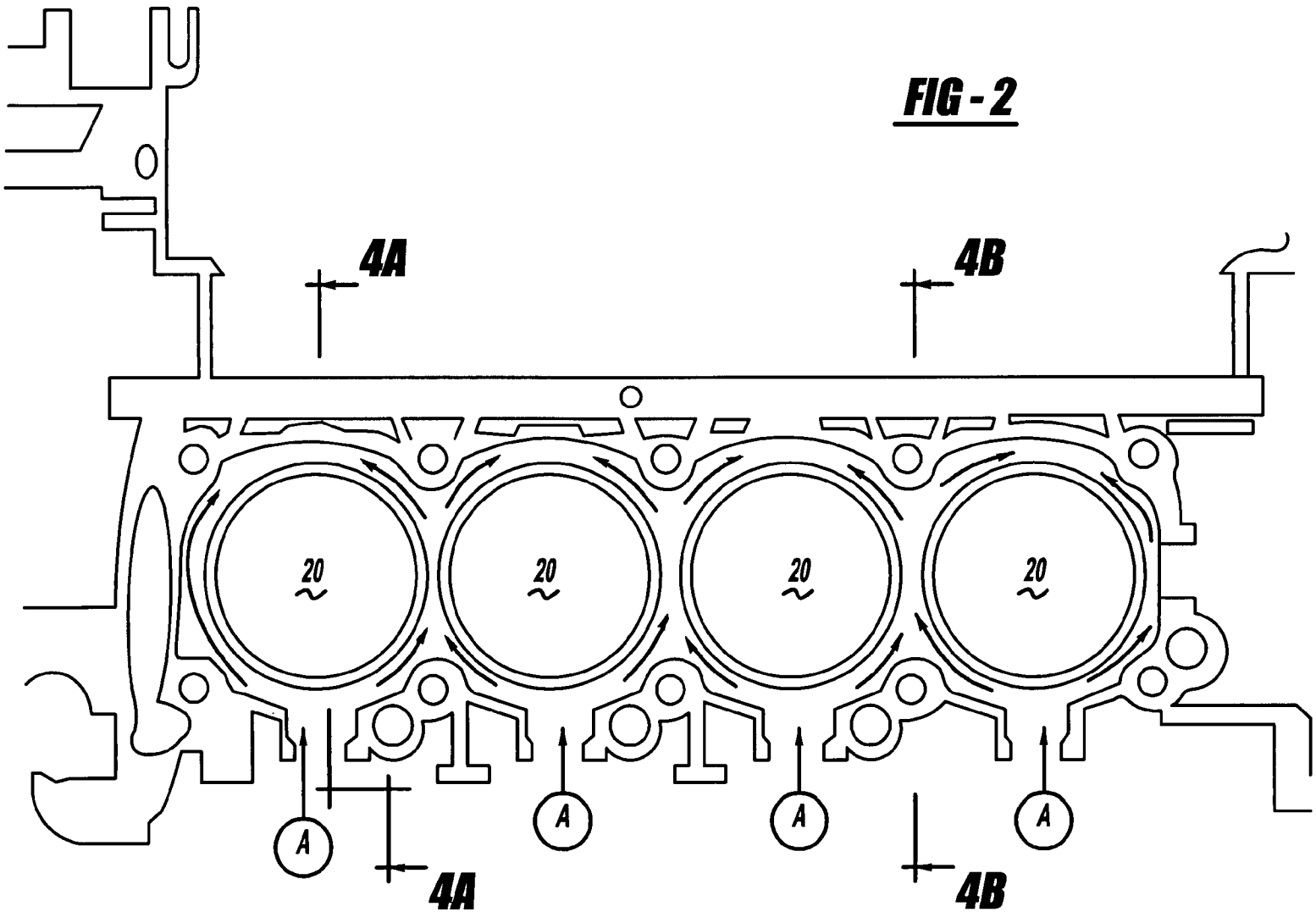
FIG. 2 is a cross-sectional view of the precision cooling system of FIG. 1, taken through line 2—2 of FIG. 5.
Figure 3:
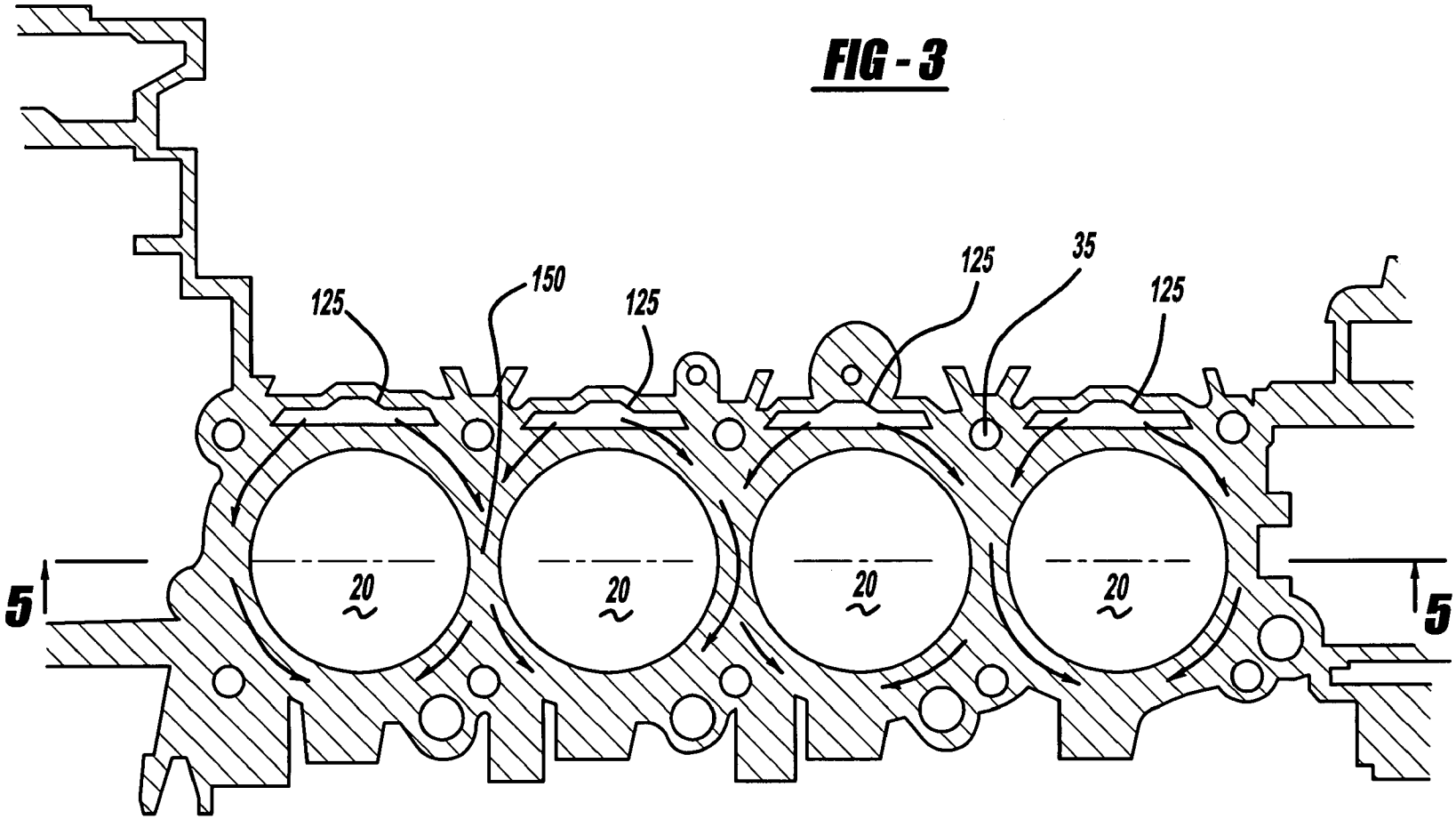
FIG. 3 is a cross-sectional view of the precision cooling system of FIGS. 1–2, taken through line 3—3 of FIG. 5.

Referring to FIG. 1, an engine block 10 of an internal combustion engine defines a plurality of cylinder bores 20. Each cylinder bore 20 is separated from an adjacent cylinder bore 20 by a cylinder bore wall 25. As shown in FIG. 1, the engine block 10 further defines a generally upper face 30 for matingly receiving a cylinder head (not shown). A plurality of threaded bores 35 are formed in the engine block 10 for receiving cylinder head bolts (not shown) for securing the cylinder head to the engine block 10. A precision cooling system 100 including a plurality of coolant channels 110 is formed in the engine block 10 adjacent to each of the cylinder bores 20, in the cylinder bore walls 25.

The precision cooling system 100 according to the invention directs the coolant flow in the engine block 10 in a manner to improve heat transfer from the cylinder bores 20 to the coolant. Coolant enters the coolant channels 110 surrounding each cylinder bore 20 through a coolant inlet 105. The coolant inlet 105 is fluidly connected to a lower coolant channel 120 surrounding each cylinder bore 20. Each lower coolant channel 120 is fluidly isolated from a corresponding upper coolant channel 130 by a dividing wall 150. The dividing wall 150 is continuous around each cylinder bore 20 except for a crossover channel 125 formed opposite the coolant inlet 105.

Figure 4:
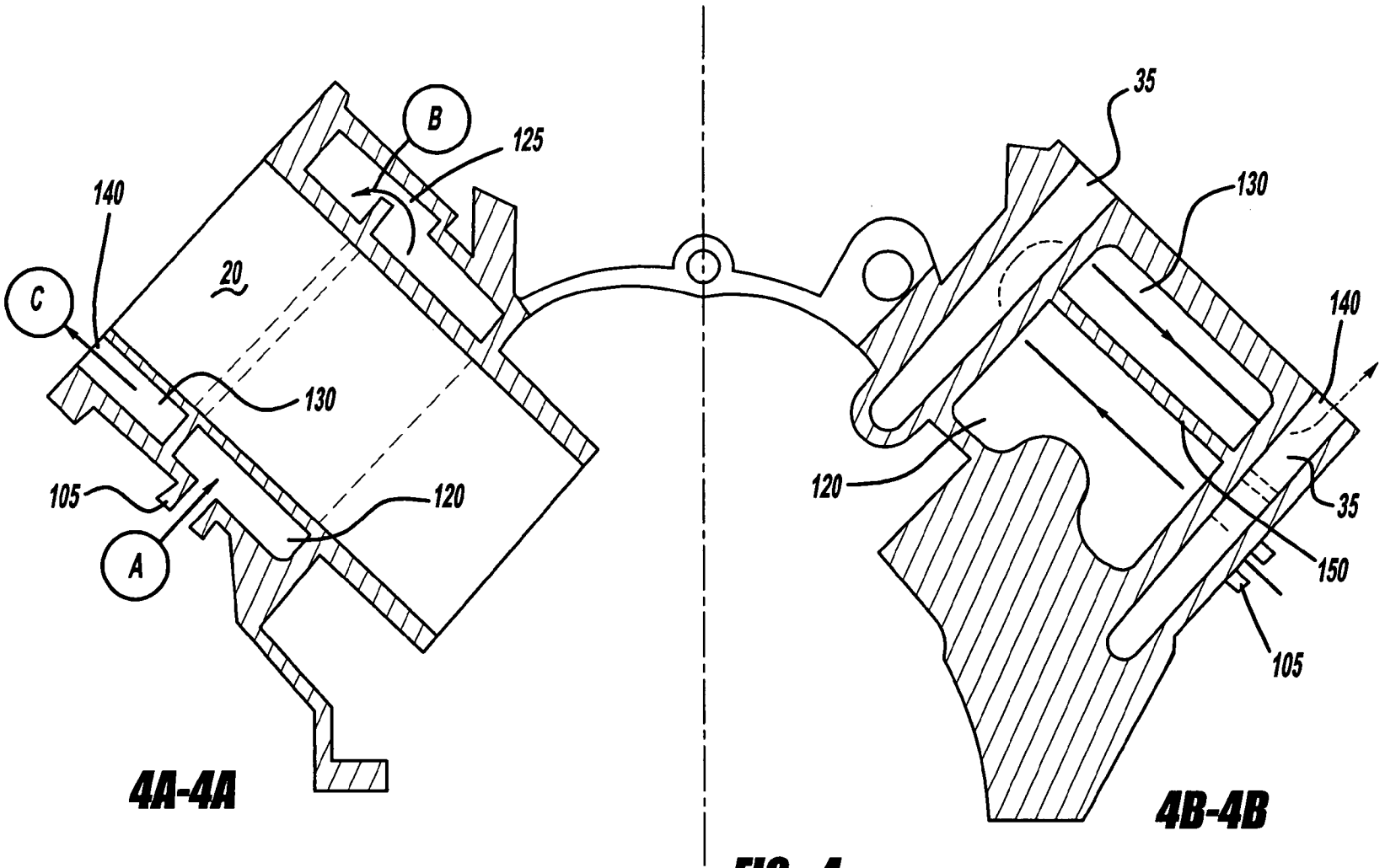
FIG. 4 is a split cross-sectional view of the precision cooling system of FIGS. 1–3, taken through lines 4A—4A and 4B—4B of FIG. 2.
Figure 5:
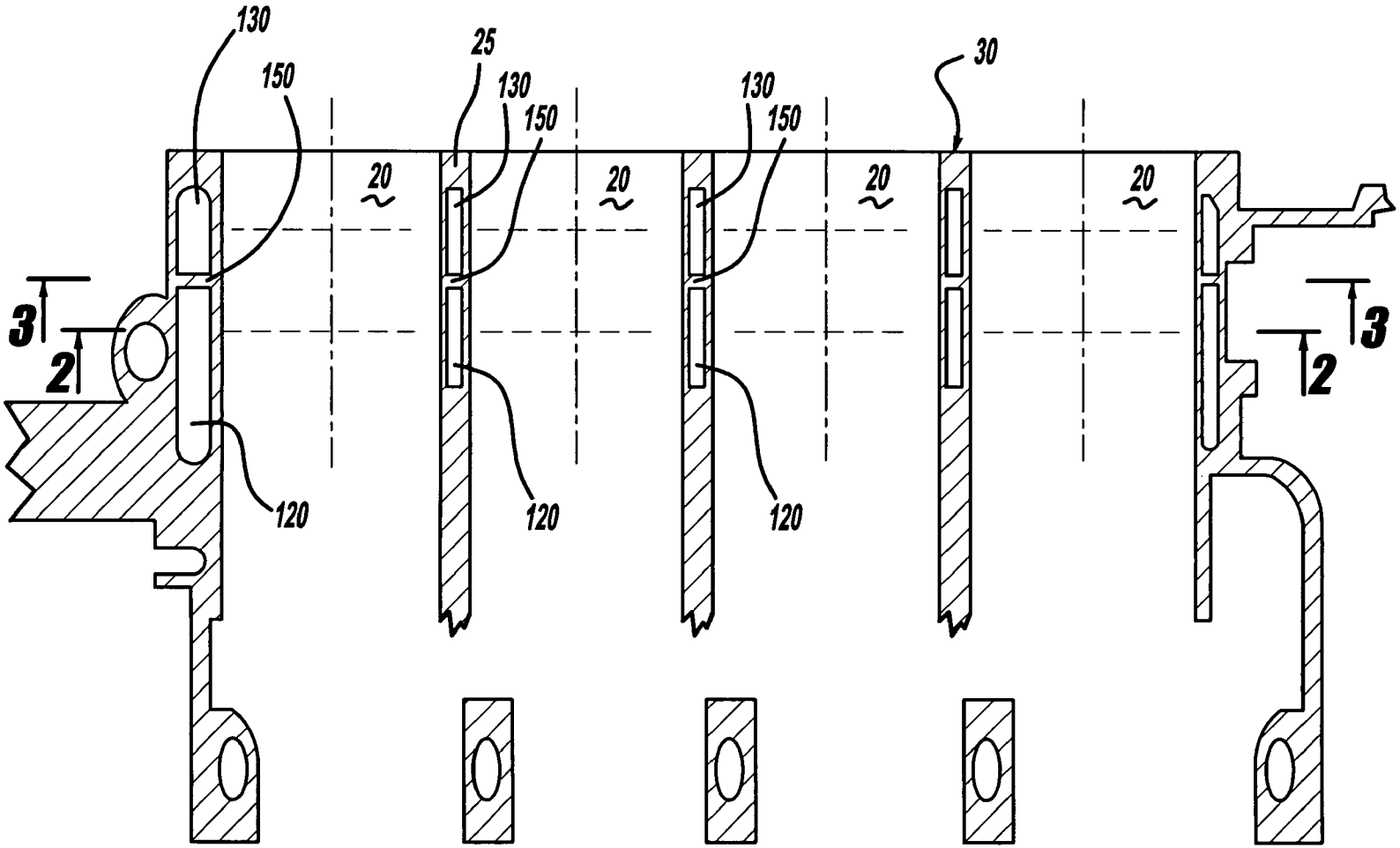
FIG. 5 is a cross-sectional view of the precision cooling system of FIGS. 1–4, taken through line 5—5 of FIG. 3.

As shown in FIG. 4, coolant flows through the coolant inlet 105 into the lower coolant channel 120, as shown at A, and around the cylinder bore 20, remaining in the lower coolant channel 120. As the coolant reaches the side of the cylinder bore 20 opposite coolant inlet 105, the coolant flows through crossover channel 125 into upper coolant channel 130, as shown at B. The coolant then flows back around the cylinder bore 20 through upper coolant channel 130 to coolant outlet 140, as shown at C. The coolant then flows from coolant outlet 140 into the cylinder head (not shown).

The position of the dividing wall 150 within the cooling channels 110 is designed to optimize the flow of coolant around the cylinder bores 20 to provide the greatest equalization of temperature in the cylinder. The factors that must be considered include coolant composition, flow rates of coolant, heat transfer rates by convection, bore and stroke dimensions, cylinder wall thickness and engine block material.

The precision cooling system according to the invention thus directs coolant in two ways differently than previously known cooling systems by introducing coolant to a bank of cylinder bores 20 in a transverse manner, ensuring that the coolant reaching each cylinder bore 20 is the same temperature, and further controlling the manner in which the coolant passes over each of the upper and lower portions of each cylinder bore 20.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the scope of the appended claims.

What is claimed is:

1. A cooling structure for an internal combustion engine having an engine block including a plurality of cylinder walls defining a plurality of combustion chambers, each of the combustion chambers having an upper end and a lower end, wherein a fuel-air combination is introduced into the upper end of each combustion chamber for combustion, the cooling structure comprising:

a plurality of coolant channels including an upper coolant channel and a lower coolant channel abutting an outer surface of the cylinder walls and fluidly connecting a coolant inlet and a coolant outlet; and a dividing wall extending between the lower coolant channel from the upper coolant channel and defining a crossover channel fluidly connecting the lower coolant channel and the upper coolant channel, wherein the coolant inlet is directly fluidly connected with one of the lower coolant channel and the upper coolant channel and the coolant outlet is directly fluidly connected with the other of the lower coolant channel and the upper coolant channel.

2. The cooling structure of claim 1, wherein the coolant inlet is directly fluidly connected with the lower coolant channel.

3. The cooling structure of claim 1, whereby coolant flows from the coolant inlet, through the lower coolant channel, crossover channel, and upper coolant channel to the coolant outlet.

4. The cooling structure of claim 1, wherein the plurality of coolant channels are defined within the cylinder walls.

5. A cooling structure for an internal combustion engine having an engine block including a plurality of cylinder walls defining a plurality of combustion chambers, each of the combustion chambers having an upper end and a lower end, wherein a fuel-air combination is introduced into the upper end of each combustion chamber for combustion, the cooling structure comprising:

a plurality of coolant channels including an upper coolant channel and a lower coolant channel defined within, and abutting, the cylinder walls and fluidly connecting a coolant inlet and a coolant outlet; and a dividing wall extending between the lower coolant channel and the upper coolant channel and defining a crossover channel fluidly connecting the lower coolant channel and the upper coolant channel, wherein the coolant inlet is directly fluidly connected with the lower coolant channel and the coolant outlet is directly fluidly connected with the upper coolant channel, whereby coolant flows from the coolant inlet, through the lower coolant channel, crossover channel, and upper coolant channel to the coolant outlet.

6. The cooling structure of claim 1, wherein the dividing wall axially surrounds the cylinder walls of the combustion chamber.

7. The cooling structure of claim 1, wherein the dividing wall separates the upper coolant channel from the lower coolant channel at a first position of the cylinder wall and permits fluid communication between the upper coolant channel and the lower coolant channel at a second position of the cylinder wall.

8. The cooling structure of claim 7, wherein the first position is diametrically opposed to the second position.

9. The cooling structure of claim 5, wherein the dividing wall axially surrounds the cylinder walls of the combustion chamber.

10. The cooling structure of claim 5, wherein the dividing wall separates the upper coolant channel from the lower coolant channel at a first position of the cylinder wall and permits fluid communication between the upper coolant channel and the lower coolant channel at a second position of the cylinder wall.

11. The cooling structure of claim 10, wherein the first position is diametrically opposed to the second position.

* * * * *